US005971611A

United States Patent [19]

Rosengren

[11] Patent Number: 5,971,611

[45] Date of Patent: Oct. 26, 1999

[54] PLAYMAT THAT CONVERTS TO A BAG

[76] Inventor: Julie May Rosengren, 760 S. 840 East, Alpine, Utah 84004

[21] Appl. No.: 09/062,321

[22] Filed: Apr. 20, 1998

[51] Int. Cl.[6] ..... B65D 30/00

[52] U.S. Cl. ..... 383/4; 383/14; 383/62; 383/75; 383/97; 5/417

[58] Field of Search ..... 383/4, 14, 62, 383/75, 97; 5/417

[56] References Cited

U.S. PATENT DOCUMENTS

| | | | |
|---|---|---|---|
| D. 299,979 | 2/1989 | Garrison | 383/4 X |
| 2,479,203 | 8/1949 | Brown | 383/4 |
| 2,908,020 | 10/1959 | Barton | 383/4 |
| 3,073,367 | 1/1963 | Samara | 383/97 |
| 3,475,767 | 11/1969 | Friesen et al. | 383/75 |
| 3,489,194 | 1/1970 | Hoover | 383/97 |
| 3,628,583 | 12/1971 | Poelman | 383/62 X |
| 4,337,812 | 7/1982 | Trinker | 383/4 |
| 4,794,029 | 12/1988 | Tennant et al. | 5/417 X |
| 4,991,978 | 2/1991 | Ostrowski | 383/4 |
| 5,078,508 | 1/1992 | Johan et al. | 383/75 |
| 5,092,681 | 3/1992 | Ashley, III | 383/4 |
| 5,265,961 | 11/1993 | Boyd | 383/75 |
| 5,429,541 | 7/1995 | Landon | 383/4 X |
| 5,482,374 | 1/1996 | Buhyoff | 383/4 |

FOREIGN PATENT DOCUMENTS

| | | | |
|---|---|---|---|
| 2077779 | 3/1993 | Canada | 383/75 |
| 23955 | 1/1989 | Japan | 383/97 |
| 162246 | 7/1991 | Japan | 383/75 |
| 2153195 | 8/1985 | United Kingdom | 383/4 |

*Primary Examiner*—Jes F. Pascua
*Assistant Examiner*—Robin A. Hylton

[57] ABSTRACT

A child's developmental product which serves as a playmat for interaction and as a storing and transportation device for a child's toys and material needs. The playmat is circular so that it can be drawn into a bag. The drawstring inserts back into the edging of the playmat and has a zipper and a keyring latch to ensure safe use of the product. There are handles for transportation of the playmat. It has poly/cotton (50/50) material on the top and vinyl on the bottom for use indoors and outdoors. A matching cushion and blanket serves as extra sources of comfort for the child.

3 Claims, 1 Drawing Sheet

PLAYMAT THAT CONVERTS TO A BAG

BACKGROUND OF THE INVENTION

The playmat pertains to the field of child development. It is a functional and safe product which adults can use to interact with children. It is a playmat for interaction as well as a bag for easy storage and transportation of children's toys and material needs.

BRIEF SUMMARY OF INVENTION

Whether it was in my own home, a relative's or friend's or outside having a picnic or sitting on the beach, I needed some type of playmat/bag I could easily transport for my child to sit and play. The playmat achieves these objectives in a variety of ways:

A safe and comfortable place for child and adult to play and sit which promotes interaction and development of essential motor neuron skills Soft and durable poly/cotton material on top and waterproof vinyl material on bottom Poly/cotton and vinyl cushion for propping baby or adult up Poly/cotton blanket for indoors and outdoors Built in drawstring for easy, convenient and safe storage Drawstring and handles for easy transportation Drawstring for collecting toys therefore creating less mess and a safer and more roomy environment Bright colours for stimulation Reversible with vinyl bottom facing down for outdoor activities such as at the beach, on the grass for a picnic, on the dirt for camping Reversible with vinyl bottom facing up for indoor activities such as playing without a diaper when child has a diaper rash, painting, drawing, cutting, gluing and eating Machine washable Quick drying Longevity as it serves many purposes as the child grows and learns Longevity for adult's use as a bag or outdoor rug in the future (such as, camping, picnicking and rock climbing)

Safety latch to keep your child safe

For use in all seasons.

Figure 1:
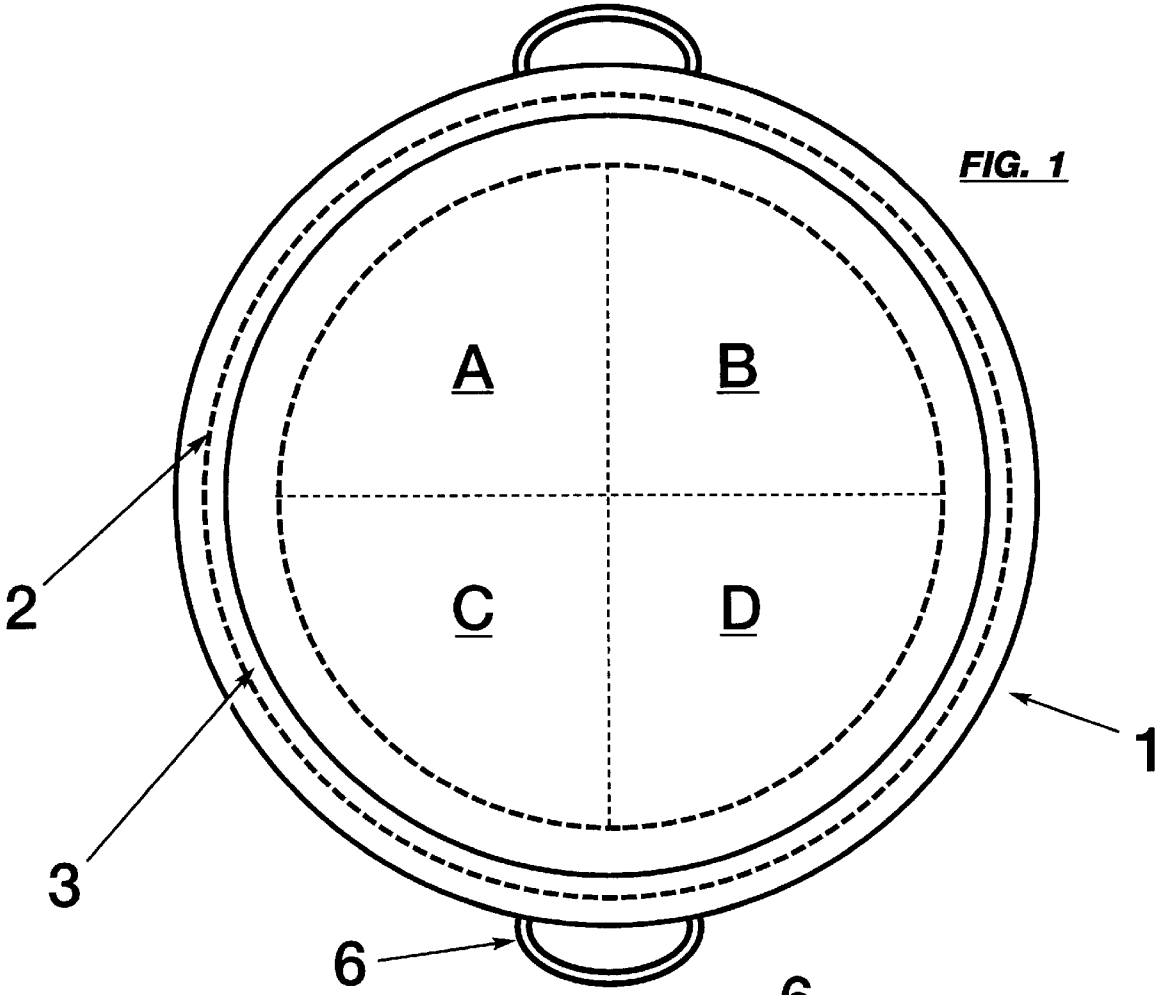
FIG. 1 is a plan view of the playmat.
Figure 2:
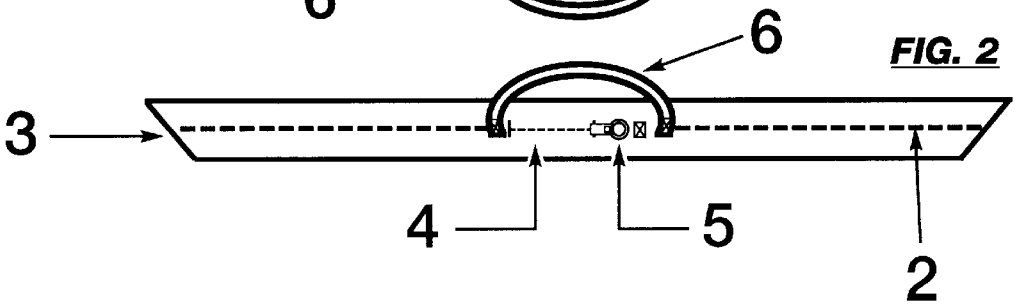
FIG. 2 is a elevational view of the playmat showing the handles and zippered opening.

These drawing figures highlight the utility aspect of the patent, that is, how it works and what its function is.

1. Kodel is the circular playmat/bag which is the main body of the product.

2. Handles are used for transportation and storage purposes as a bag.

3. Zipper pocket contains the drawstring so that the playmat can be drawn into a bag. A swag in Australia was used by the folk lore hero Waltzing Matilda as he roamed the countryside, it rolled out into a bed but was also used to carry his belongings.

DETAILED DESCRIPTION OF THE INVENTION

The playmat (1) promotes a child's development and a bag which provides an easy way to transport and store toys and a child's material needs. The playmat is circular so that it can be drawn into a bag. The drawstring (2) inserts back into the edging or pack cloth sleeve (3) of the playmat and has a zipper (4) and a keyring latch (5) to ensure safe use of the product. There are handles (6) for transportation of the playmat. It has poly/cotton (50/50) material on the top and vinyl on the bottom for use indoors and outdoors.

Materials and Instructions for Making the Playmat

Poly/cotton voyager knit (50%—50%) 25.5 inch diameter in quarter wedge by 4 full wedges (a,b,c,d) equals 160.2 circumference and 51 inch diameter colours red, blue, yellow and green Vinyl 25.5 inch diameter in quarter wedge by 4 full wedge equals 160.2 circumference and 51 inch diameter colours red, blue, yellow and green Polyester Batting 1 piece 51 inch diameter circle 1 zipper 10 inches in length with one single pull slider Pack cloth sleeve 10 inches by 160.2 inches Drawstring 200 inches 2—#0 Spur grommets 1—Cord lock (drawstring)

1—¾ inch key ring (slider lock)

28 inches—1 Inch Royal Blue PolyPro webbing (2 handles) cut 14 inches each

Inner Playmat

1. Sew quarters together in proper colour scheme.

2. Serge top poly/knit material together.

3. Sew bottom vinyl fabric together with ⅜ inch seam.

4. Put batting in between circles matching colours top and bottom. Staple in place at seams.

5. Sew lines for quilting (4) and remove staples as lines are sewn.

6. Serge completely around the outer edge of circle to hold all three layers together.

Outer Sleeve

1. Sew four pieces of outer ring together with ½ inch seam. Top stitch each seam (8) total making two rings. In bottom ring install zipper and closure ring. In top ring in middle of zipper pocket install grommet tabs and drawstring.

2. Sew outer edges of outer ring together with ½ inch seam turn and top stitch.

3. To attach outer ring to and set playmat in between top and bottom ring matching colour markings. Sew around the playmat making sure the drawstring is inside the rings next to the outer edge. Turn under ½ inch in sewing ring to playmat. Sew back edge first putting labels in under zipper area. Flip playmat over and sew down outer ring to vinyl in same fashion. Sew handles down on outer ring where marked.

4. Burn edge of drawstring and attach cordlock.

Baby Blanket

Poly/cotton voyager knit colours, red, blue, yellow and green 38 inches by 26 inches each wedge 12 inches by 18 inches Sew four quarters of material together across the middle sections and around edges.

Cushion Cover

1. Poly/cotton voyager knit colours, red, blue, yellow and green 16 inches by 16 inches each wedge is 8 inches by 8 inches Pack Cloth 1. Sew four quarters of material together across the middle section and around the edges.

2. Sew onto pack cloth inside out.

I claim:

1. A child development playmat-bag device which is adapted to move between an open and a closed position and which in the open position provides a playmat suitable for interaction and in the close position provides an enclosed bag for carrying toys and other essentials, said child development playmat-bag comprising:

a circular, multi-layer body having a periphery, a top layer and a bottom layer, wherein the top layer is a poly/cotton material and the bottom layer is a vinyl material, an outer circumferential sleeve sewn to the circular multi-layer body periphery, said circumferential sleeve comprising an opening therein having a zipper closure including a slider for movement of the zipper between an open and a closed position, and a slider lock for engaging said slider and maintaining said zipper in said closed position, a drawstring passing through the outer circumferential sleeve to permit the playmat-carrying device to move between said open position with the drawstring in a relaxed, extended position and said closed position for use as a carrying bag with the drawstring in a drawn position, said drawstring secured within the opening when in the relaxed, extended position for safety purposes, said drawstring comprising a cord lock, and two diametrically opposed handles attached to the outer circumferential sleeve.

2. The child development playmat-bag device according to claim 1, wherein said outer circumferential sleeve is a pack cloth sleeve.

3. The child development playmat-bag device according to claim 1, further comprising a matching cushion and blanket.

* * * * *